US006481102B1

(12) United States Patent
Hill

(10) Patent No.: US 6,481,102 B1
(45) Date of Patent: Nov. 19, 2002

(54) ATTACHMENT DEVICES, SYSTEMS, AND METHODS FOR A TENDON, ROD, OR OTHER ELONGATED MEMBER

(76) Inventor: Tommie D. Hill, 4545 Health Rd., Nashville, TN (US) 37221

( * ) Notice: Subject to any disclaimer, the term of this patent is extended or adjusted under 35 U.S.C. 154(b) by 0 days.

(21) Appl. No.: 09/452,973

(22) Filed: Dec. 2, 1999

(51) Int. Cl.[7] ..... B23P 17/00

(52) U.S. Cl. ..... 29/897.34; 29/458

(58) Field of Search ..... 29/897.34, 413, 29/424, 446, 452, 527.1, 458, 527.2; 52/745.21, 704, 707; 156/293, 294; 206/222, 219, 526; 405/259.5, 259.6; 81/54; 403/265, 267, 268

(56) References Cited

U.S. PATENT DOCUMENTS

| | | | | | |
|---|---|---|---|---|---|
| 2,921,463 | A | | 1/1960 | Goldfein | |
| 3,167,882 | A | | 2/1965 | Abbott | |
| 3,618,326 | A | * | 11/1971 | Montgomery | 405/259.6 |
| 3,877,235 | A | * | 4/1975 | Hill | 405/259.6 |
| 4,037,979 | A | | 7/1977 | Fastenau | |
| 4,235,055 | A | | 11/1980 | Schambeck | |
| 4,291,799 | A | * | 9/1981 | Bower, Jr. | 206/219 |
| 4,345,686 | A | | 8/1982 | Sato et al. | |
| 4,393,638 | A | * | 7/1983 | Sell et al. | 405/259.6 |
| 4,360,288 | C1 | | 12/1983 | Rutledge, Jr. et al. | |
| 4,433,933 | A | | 2/1984 | Parsons, Jr. et al. | |
| 4,442,646 | A | | 4/1984 | Prevedini | |
| 4,497,403 | A | * | 2/1985 | Rausch | 206/219 |
| 4,531,861 | A | * | 7/1985 | Kash | 405/259.6 |
| 4,564,315 | A | * | 1/1986 | Rozanc | 405/259.6 |
| 4,620,401 | A | | 11/1986 | L'Esperance et al. | |
| 4,662,774 | A | | 5/1987 | Morrow, Jr. | |
| 4,666,326 | A | | 5/1987 | Hope | |
| 4,724,639 | A | * | 2/1988 | Moser | 29/452 |
| 4,752,171 | A | | 6/1988 | Pliml, Jr. | |
| 4,934,118 | A | | 6/1990 | Miebeler | |
| 5,046,878 | A | | 9/1991 | Young | |
| 5,230,199 | A | | 7/1993 | Yee | |
| 5,249,898 | A | | 10/1993 | Stepanski et al. | |
| 5,314,268 | A | * | 5/1994 | Calandra et al. | 405/259.5 |
| 5,383,740 | A | | 1/1995 | Lancelot, III | |
| 5,392,582 | A | | 2/1995 | Abukawa | |
| 5,440,842 | A | | 8/1995 | Sorkin | |
| 5,596,854 | A | | 1/1997 | Crigler | |
| 5,613,334 | A | | 3/1997 | Petrina | |
| 5,630,301 | A | * | 5/1997 | Sieg | 52/745.21 |
| 5,732,525 | A | | 3/1998 | Mochizuki et al. | |
| 5,738,278 | A | | 4/1998 | Franz et al. | |
| 5,763,026 | A | * | 6/1998 | Makino et al. | 206/219 |

* cited by examiner

*Primary Examiner*—I Cuda Rosenba
*Assistant Examiner*—T. Nguyen
(74) *Attorney, Agent, or Firm*—Woodard, Emhardt, Naughton Moriarty & McNett

(57) ABSTRACT

A method of the present invention comprises providing an attachment device including a first end portion that defines a cavity and an opening intersecting the cavity. The attachment device also includes one or more components of an adhesive material positioned in the cavity and at least one frangible barrier to retain these components in the cavity. The method further includes inserting a free end of a tendon through the opening and into the cavity to break the barrier, rotating the attachment device about the tendon to disperse the one or more components of the adhesive material within the cavity, and coupling the tendon to the attachment device with the adhesive material after rotation.

17 Claims, 5 Drawing Sheets

ATTACHMENT DEVICES, SYSTEMS, AND METHODS FOR A TENDON, ROD, OR OTHER ELONGATED MEMBER

BACKGROUND

The present invention relates to attachment techniques, and more particularly, but not exclusively, relates to devices, systems, and methods for attaching, anchoring, or manipulating tendons, rods, or other elongated members.

The use of rigid rods, tendons, and bars in various industries is widespread. For instance, concrete beam construction often benefits from incorporating steel tendons along the longitude of the beam. Typically, such applications include the connection of an anchoring device to an end of the tendon extending from the beam. In another instance, rods, tendons, and/or bars may be connected end to end for various applications. For example, sucker rods used in oil-well pumps are commonly coupled in this manner. In still other applications, different connections, fittings, and couplings are attached to tendons and other elongated members. Thus, there is a demand for farther technological development in the area of such attachment devices.

Indeed, one recent advancement has been the development of composite tendons. While this type of tendon has certain advantages over more traditional compositions, such as steel, there are also drawbacks. For instance, this kind of tendon is often sensitive to transverse pressure and cannot readily be clamped and tensioned in the manner commonly used for steel tendons. Thus, attachment devices suitable for composite tendon compositions are also desired.

SUMMARY OF THE INVENTIONS

One form of the present invention is a unique attachment device for an elongated member.

In another form of the present invention, a unique tendon attachment device is provided. For this form, the tendon to be attached may be a rod, bar, strand, fiber, cord, cable, wire, or bundle of such items. Further, the tendon may be made of a metallic material such as steel, a composite material such as a fiber-reinforced polymeric resin, a combination of metallic and composite materials, or such other composition as would occur to those skilled in the art.

A further form of the present invention includes a unique system having an elongated member and an attachment device. This system may be used to anchor a tendon, couple it to another tendon, or otherwise manipulate it.

In still another form, a unique technique includes providing an attachment device having an adhesive retained in a cavity by a frangible partition, barrier, or membrane. An elongated member, such as a tendon, is inserted into the cavity, breaking the partition, barrier, or membrane, as applicable, and coming into contact with the adhesive. Correspondingly, the adhesive bonds with the elongated member to couple it to the attachment device.

Further forms, embodiments, objects, aspects, and features of the present invention shall become apparent from the drawings and description contained herein.

BRIEF DESCRIPTION OF THE DRAWINGS

FIG. 2 further provides a partial view of a tendon (not in section).

DESCRIPTION OF THE PREFERRED EMBODIMENTS

Figure 1:
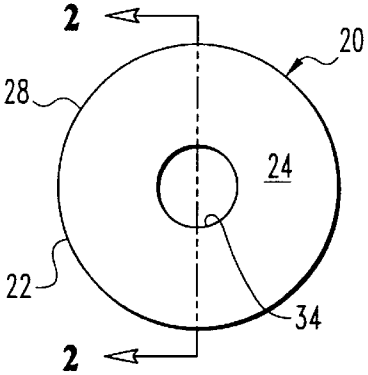
FIG. 1 is an end view of an attachment device.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
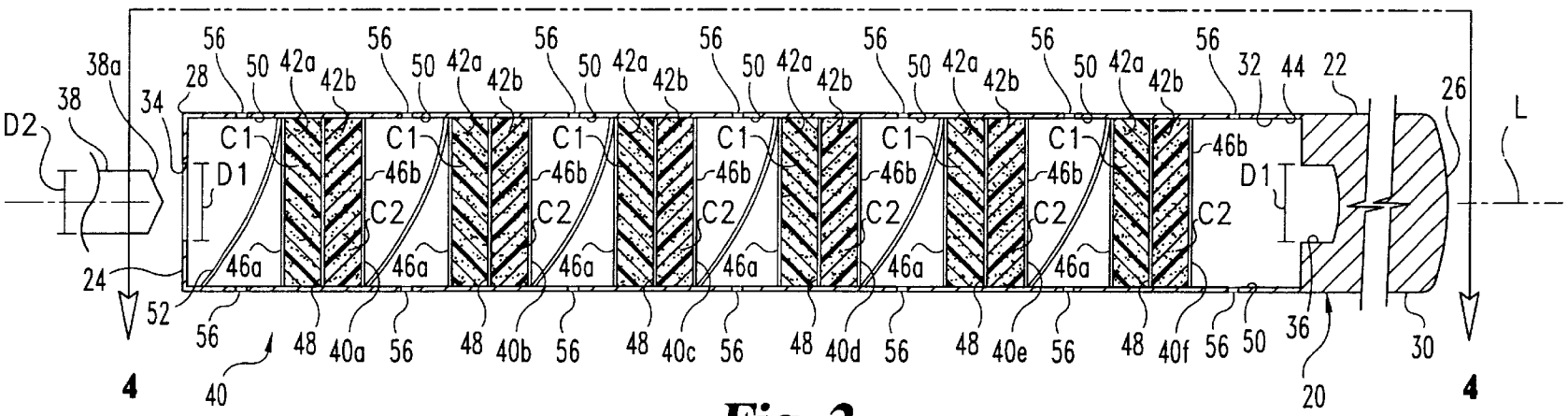
FIG. 2 is a partial sectional side view of the attachment device of FIG. 1 taken long section line 2—2 of FIG. 1.
Figure 3:
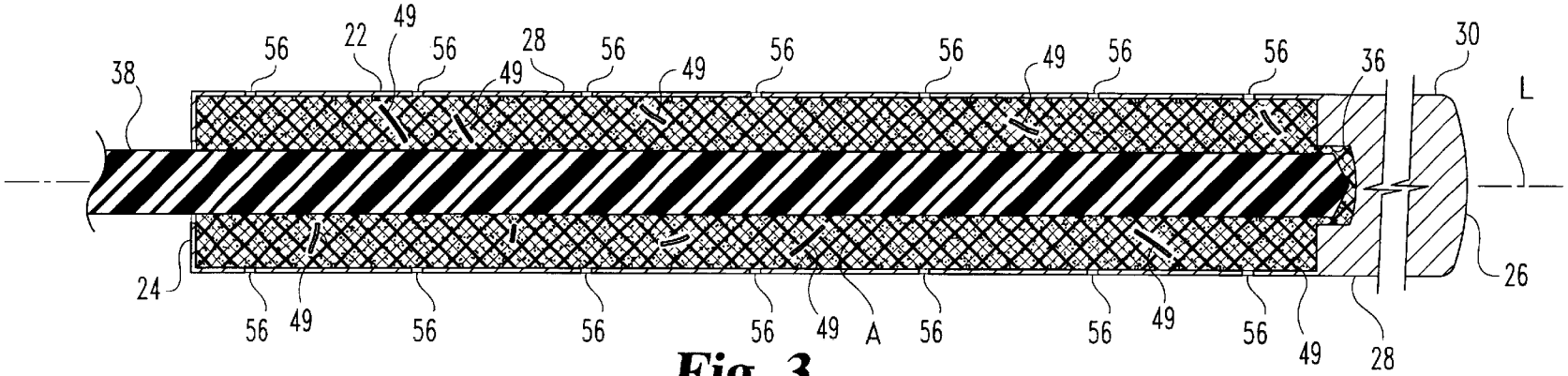
FIG. 3 is a sectional side view of the attachment device of FIGS. 1 and 2 after insertion of the tendon of FIG. 2 therein.
Figure 4:
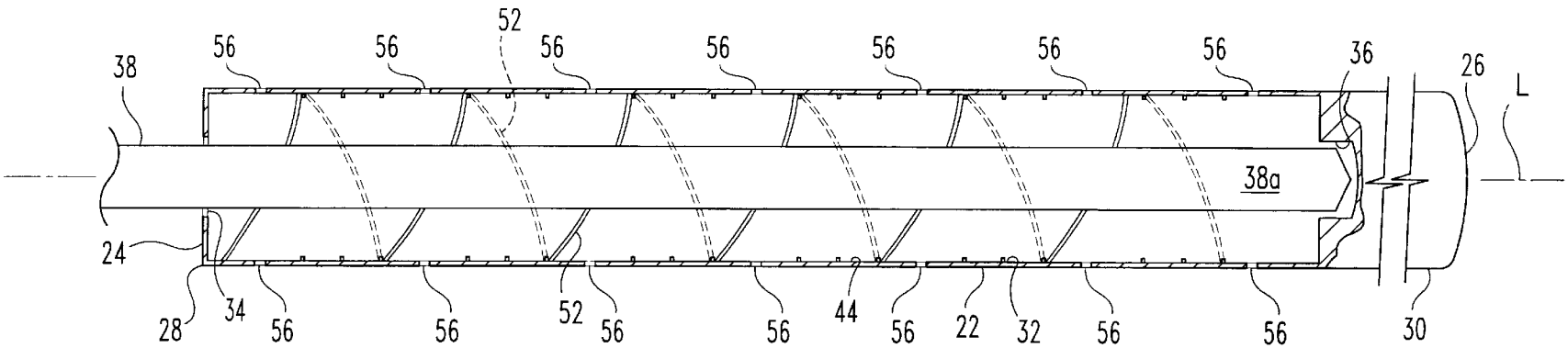
FIG. 4 is a partial sectional side view of the attachment device of FIG. 3 with adhesive material removed to better show selected features of the attachment device. For the view of FIG. 4, the tendon is not sectioned.

Referring to FIGS. 1–4, attachment device 20 of one embodiment of the present invention is illustrated. Attachment device 20 includes a generally cylindrically shaped body 22 that has end portion 24 opposite end portion 26 along its longitudinal axis L. In FIGS. 2–4, axis L is depicted coincident with a centerline axis of attachment device 20. Body 22 comprises attachment member 28 that includes end portion 24, and engagement member 30 that includes end portion 26. Body 22 may be made of a metallic material, such as steel or aluminum, a composite material including a thermoplastic or thermoset polymeric resin with glass, graphite, or other fiber reinforcement, a combination of such materials, or such other composition as would occur to those skilled in the art.

Engagement member 30 may be configured for coupling to a tool and/or for anchoring attachment device 20. Attachment member 28 defines cavity 32. End portion 24 defines opening 34 intersecting cavity 32. Opposite opening 34, attachment member 28 defines alignment recess 36. Opening 34 and recess 36 are sized to receive tendon 38 as shown in FIGS. 2–4. In FIG. 2, tendon 38 is positioned just outside of cavity 32 in alignment with opening 34 along axis L. In FIGS. 3 and 4, tendon 38 is shown inside cavity 32 after insertion through opening 34. Opening 34 and recess 36 have a generally circular cross-section taken along axis L of attachment device 20. Diameter D1 of opening 34 and recess 36 is slightly larger than diameter D2 of tendon 38, as best illustrated with respect to tendon end portion 38*a* shown in FIG. 2.

Referring specifically to FIG. 2, a number of adhesive containers 40*a*, 40*b*, 40*c*, 40*d*, 40*e*, 40*f* are illustrated within cavity 32, (collectively designated containers 40). Containers 40 are spaced apart from one another along cavity 32, and correspondingly axis L, to define a number of spaces 50. Each container 40 defines a pair of pockets or chambers 42*a*, 42*b* (collectively designated pockets 42). For each container 40, chamber 42*a* contains a first part or component C1 of an adhesive material and chamber 42*b* contains a second part or component C2 of the adhesive material. For example, pockets 42 for a given container 40 may each contain a different component of a two-part epoxy compound. Generally, components C1, C2 may be in a liquid, gel, powder, granulated, or other form as would occur to those skilled in the art.

Containers 40 are each bounded by a pair of frangible barriers 46*a*, 46*b* that are in the form of a film or membrane spanning across cavity 32 and attached to wall 44 of attachment member 28. Each pair of chambers 42*a*, 42*b* for a given container 40 are defined by the corresponding pair of barriers 46*a*, 46*b*, and a frangible partition 48 inserted therebetween. Partition 48 of each container 40 separates the two adhesive components C1, C2 contained in each chamber 42*a*, 42*b*, respectively. Frangible partitions 48 may each be formed in the same manner and of the same material as frangible barriers 46*a*, 46*b*. In other words, barriers 46*a*, 46*b* and partitions 48 may each be one of a number of frangible members that are each generally the same from one to the next. Still, in other embodiments, one or more barriers 46*a*, 46*b* and/or partitions 48 may differ from the others as would occur to those skilled in tie art.

It should be appreciated that spaces 50 of cavity 32 are each defined by one or ore of barriers 46*a*, 46*b*. Correspondingly, an arrangement of layers of adhesive components C1, C2, and spaces 50 are stacked along axis L, as defined by corresponding barriers 46*a*, 46*b* and partitions 48. Further, attachment member 28 defines a number of apertures 56 through wall 44 that each intersect one of spaces 50 as shown in FIGS. 2–4. Flange 52 extends from wall 44 of attachment member 28 into cavity 32. Flange 52 generally follows a helical pattern about a centerline of cavity 32; where in FIGS. 2–4, axis L is positioned coincident with this centerline. Referring specifically to FIG. 4, a dashed line represents the path of flange 52 along the portion of attachment member 28 that has been cut away to provide the corresponding partial sectional view.

Having described selected features of FIGS. 1–4, one example of the operation of attachment device 20 is next described. Referring to FIG. 2, each of the spaced apart containers 40 retain at least one component C1, C2 of an adhesive material in cavity 32 in a sealed, uncured condition with a corresponding pair of barriers 46*a*, 46*b*. Components C1, C2 of each pair of chambers 42*a*, 42*b* are separated by a corresponding frangible partition 48. To couple tendon 38 to attachment device 20, tendon end portion 38*a* is inserted through opening 34 into cavity 32 to bear against barrier 46*a* of container 40*a*. With increasing pressure of tendon 38 on container 40*a*, its corresponding barrier 46*a* is configured to break away from wall 44, tear, and/or otherwise deform such that component C1 in corresponding chamber 42*a* is released into cavity 32. In one embodiment, a predetermined location along barrier 46*a* is scored or "thinned" to define a break away point close to inner wall 44. Barrier 46*a* may be arranged to completely break away from inner wall 44 or at least a portion of barrier 46*a* may remain connected to inner wall 44 after rupture by tendon 38. After barrier 46*a* of container 40*a* is ruptured, the adjacent partition 48 is configured to break, rupture, and/or tear in response to pressure applied by tendon 38 and deform such that component C2 in corresponding chamber 42*b* is released into cavity 32. With continued pressure being applied by tendon 38, the barrier 46*b* of container 40*a* is ruptured and displaced along with barrier 46*a* and partition 48, such that tendon 38 reaches the next container 40*b*. Barrier 46*b* and/or partition 48 may be arranged to rupture as described in connection with barrier 46*b*. It should be understood that at least a portion of displaced barriers 46*a*, 46*b* and/or partition 48 of container 40*a* may be positioned between tendon 38 and container 40*b* after rupture or tendon 38 may contact container 40*b* directly. Continued pressure subsequently breaks/tears barriers 46*a*, 46*b* and partition 48 of container 40*b*. The components C1, C2 in container 40*b* are correspondingly released into cavity 32. Tendon 38 then exerts pressure on container 40*c*. With continued application of pressure by tendon 38, the remaining containers 40*c*–40*f* are ruptured, one after the next, releasing their components C1, C2 into cavity 32; and tendon 38 continues to advance toward inner end 47 of attachment device 20. As shown in FIG. 3, after rupture of container 40*f*, tendon end portion 38*a* comes to rest in alignment recess 36 at inner end 47 with the corresponding container fragments 49 from barriers 46*a*, 46*b* and partitions 48 distributed along cavity 32.

During the insertion of tendon 38 into cavity 32, apertures 56 provide for the venting of air or other gases from spaces 50 as they are displaced by the sequential rupturing of containers 40*a*–40*f*. In one example, apertures 56 permit gases to escape, but are sized small enough to substantially prevent the escape from cavity 32 of a more viscous material composition selected for components C1 and C2. However, in other embodiments, the size, quantity, and arrangement of apertures may differ. Indeed, in one alternative embodiment, apertures 56 are absent. Further, the volume defined by spaces 50 is selected to be generally equal to that occupied by tendon 38 once fully inserted into attachment device 20. However, in other embodiments, this volumetric relationship may be absent.

FIG. 3 illustrates attachment device 20 after tendon 38 has displaced containers 40 to release and combine components C1 and C2. In FIG. 3, intermingled adhesive components C1, C2 are collectively designed adhesive material A and symbolically represented by a cross-hatch pattern with two alternating line weights. Once adhesive material A is established from components C1, C2, a bond may be formed between adhesive material A and tendon 38 left in its inserted position as shown in FIGS. 3 and 4. The cross-hatch pattern of FIG. 3 is not shown in FIG. 4 to better illustrate the path followed by flange 52 and its relationship to tendon 38.

It should be appreciated that recess 36, having a diameter comparable to opening 34, tends to center tendon 38 in cavity 32 when engaged thereby. Nonetheless, in other embodiments, recess 36 may be absent. Further, in alternative embodiments, tendon 38 need not initially puncture barriers 46*a*, 46*b* and/or partitions 48 of containers 40 to release components C1 and C2. Instead, barriers 46*a*, 46*b* and/or partitions 48 of containers 40 may break away from wall 44 and be pushed by tendon 38 toward inner end 47. In still another embodiment, one or more fragments 49 are arranged to fold about tendon end portion 38*a* as it is driven further into cavity 32 and recess 36 is sized to receive tendon end portion 38*a* with the one or more folded fragments carried thereon. In yet another embodiment, one or more barriers 46*a*, 46*b* and/or partitions 48 do not completely separate from wall 44, but instead are pierced, pushed aside, or otherwise displaced to permit passage of tendon 38 through cavity 32 from one container 40 to the next.

In certain instances, it may be desirable to move attachment device 20 relative to tendon 38 to assist in intermixing components C1, C2, and correspondingly provide a more uniform consistency of adhesive material A and/or drive-out gas pockets and voids from cavity 32. Indeed, by rotating attachment device 20 relative to tendon 38 after insertion of tendon 38, flange 52 assists with mixing and dispersing adhesive material A throughout cavity 32. After desired intermixing (if any), adhesive material A cures or sets, fixing tendon 38 to attachment device 20. Flange 52 may be configured to provide bearing surfaces for adhesive material A once it has set or cured. For such embodiments, the dimensions, geometry, pitch, and/or quantity of flanges 52 may be arranged to accommodate forces expected to be exerted during nominal use. of tendon 38 and attachment device 20 when joined together by adhesive material A Nonetheless, in other embodiments, flange 52 may be absent.

Figure 5:
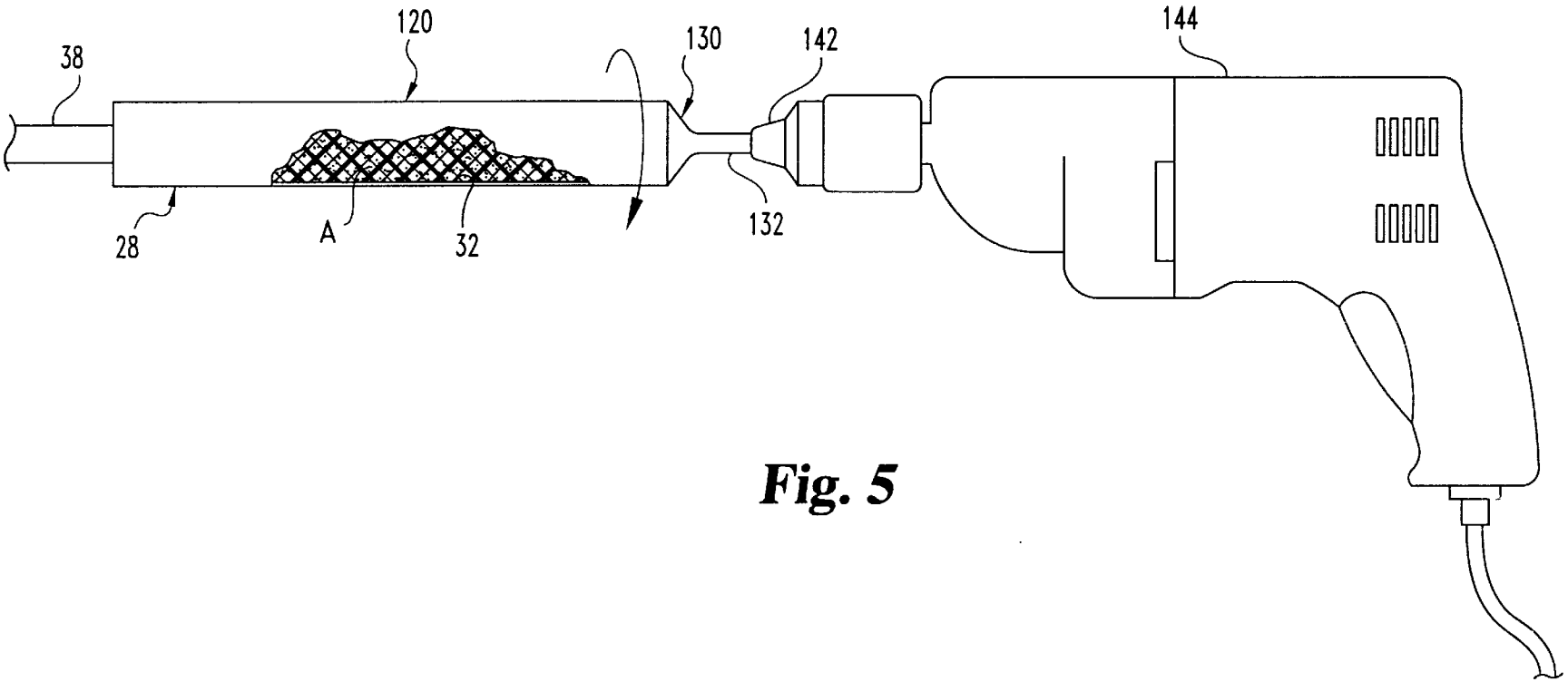
FIG. 5 is a partial sectional, cutaway side view of an attachment device adhesive mixing system of the present invention.

Rotation of the attachment device to facilitate adhesive component mixing, may be performed through the application of one or more tools. For example, referring additionally to FIG. 5, an attachment device 120 is shown with tendon 38 inserted therein. With respect to FIGS. 1–4, like reference numerals of FIG. 5 refer to like features. Attachment device 120 is configured substantially the same as attachment device 20 including attachment member 28. However, instead of engagement member 30, attachment device 120 has engagement member 130. Notably, engagement member 130 is tapered to terminate with stem 132. Stem 132 of engagement member 130 is coupled to chuck 142 of rotary power tool 144. Tool 144 is shown in the form of a power drill. Once tendon 38 has been inserted into attachment member 28 to correspondingly displace and release components C1, C2 of the adhesive material into cavity 32, further intermixing of components C1, C2 is accomplished by activating tool 144 such that attachment device 120 rotates about tendon 38 to provide a more uniform adhesive and/or reduce voids or gas pockets.

During rotation of attachment device 120 about tendon 38 with tool 144, flange 52 of attachment member 28 protrudes from wall 44, contacting components C1, C2 and assisting with the mixing thereof to provide a more uniform consistency of adhesive material A. Additionally or alternatively, tendon 38 may be rotated within cavity 32 to further mix components C1, C2. Indeed, in one alternative embodiment, tendon 38 includes spiral or helical flighting projecting therefrom to aid in mixing of the components either in addition to or as an alternative to flange 52. Also, in other embodiments, a different method of rotation or mixing besides tool 144 may be utilized as would occur to those skilled in the art. Once intermixed, adhesive material A forms a bond with tendon 38 as described for attachment device 20. In still other embodiments, it may not be desired to provide for further mixing and dispersion through rotation of the attachment device and/or tendon before bonding.

Figure 6:
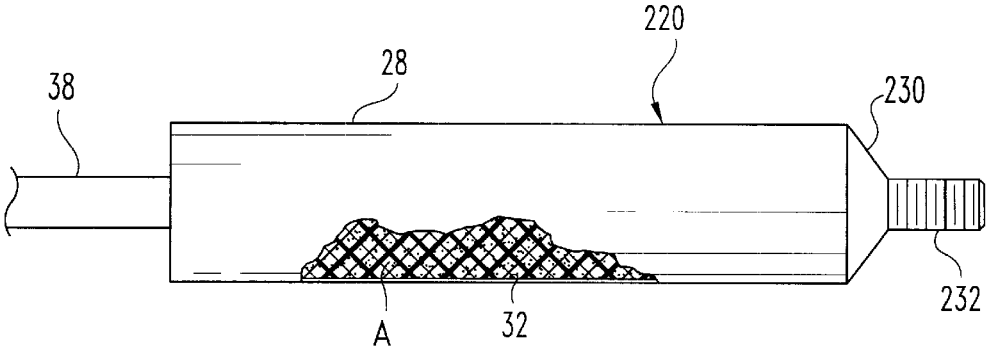
FIG. 6 is a partial sectional, cutaway side view of another attachment device connected to a tendon.

Attachment device 20, 120 may be utilized to facilitate anchoring of tendon 38 or to otherwise attach or manipulate tendon 38 as required. Referring to FIG. 6, attachment device 220 is illustrated, where like reference numerals refer to like features previously described. Attachment device 220 includes attachment member 28 and is configured substantially the same as attachment device 20 with tendon 38 being fully inserted and forming a bond with adhesive material A. Adhesive material A is shown in the cutaway portion of attachment member 28. Instead of engagement member 30 shown in FIGS. 2–4, attachment device 220 includes a tapered engagement member 230 having a threaded stem 232. Threaded stem 232 may be engaged by a threaded hole of a tool to manipulate tendon 38. For example, a stress jack may be arranged to engage threaded stem 232. In other examples, threaded stem 232 may be engaged by a nut or other threaded collar to anchor it to a plate or fasten it to another device.

Figure 7:
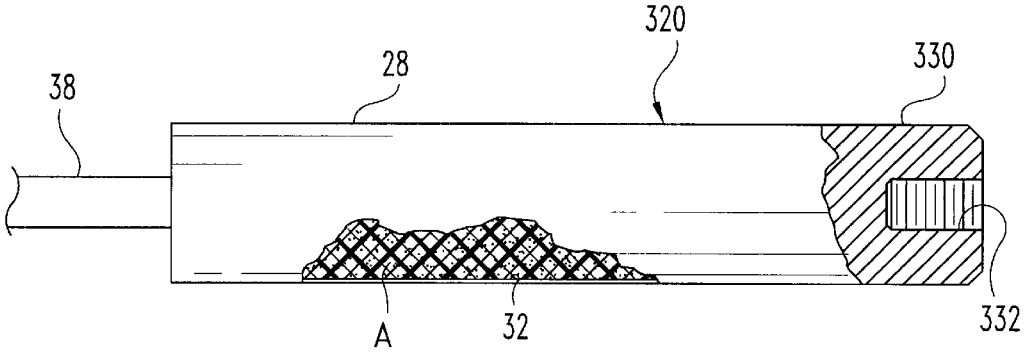
FIG. 7 is a partial sectional, cutaway side view of still another attachment device connected to a tendon.

Referring to FIG. 7, tendon 38 is coupled to attachment device 320 by adhesive material A contained within attachment member 28 as shown in a partial cutaway view thereof. Attachment device 320 differs from attachment device 20 in that it has engagement member 330 in place of engagement member 30. Engagement member 330 defines threaded bore 332 configured for engagement by a tool, like a stress jack, or attachment to another member such as a threaded rod or screw. Indeed, a screw may be used to anchor attachment device 320 to a plate or facilitate fastening to another member as would occur to those skilled in the art. Further, it should be appreciated that stem 232 and bore 332 of attachment device 220, 320, respectively, may be utilized to couple one to the other or to form tendon couplers to connect more than two tendons together. Additionally or alternatively, stem 232 and/or bore 332 may be utilized to couple corresponding attachment device 220, 320 to a drill or other rotary instrument to mix and/or disperse adhesive as described in connection with FIG. 5.

Figure 8:
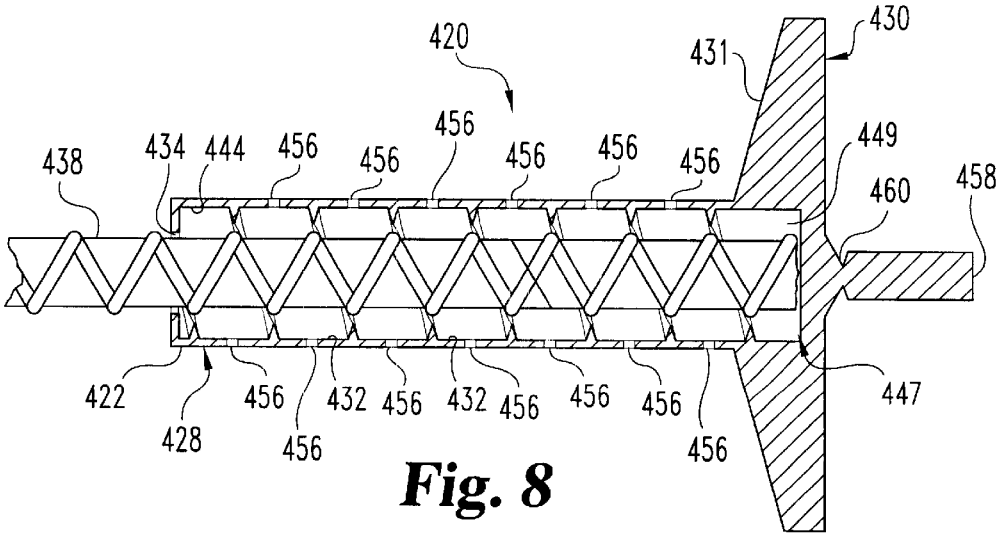
FIG. 8 is a partial sectional side view of yet another attachment device with a tendon inserted therein.

Still another embodiment of the present invention is illustrated in FIG. 8 as attachment device 420. Attachment device 420 includes body 422 defining cavity 432 with an opening 434 configured to receive tendon 438. Cavity 432 and opening 434 are included as part of attachment member 428 of body 422. Body 422 also includes engagement member 430 positioned opposite attachment member 428 along axis L. Engagement member 430 is in the form of an annular bearing collar 43 l. Mixing flange 452 extends from wall 444 of body 422. A number of apertures 456 are defined through wall 444 to intersect cavity 432. As in the case of attachment device 20, a number of spaced apart adhesive containing containers, such as containers 40 of attachment device 20, may be included in cavity 432 prior to insertion of tendon 438. For the view shown in FIG. 8, tendon 438 has been inserted to engage end wall 449 at end 447 of cavity 432. Adhesive is not shown in cavity 432 to preserve clarity. A frangible stem 458 is attached to collar 431 of engagement member 430 with a notched break point 460. Stem 458 may be engaged to a drill or other rotating device as described in connection with FIG. 5 to spin attachment device 420 about tendon 438 to thereby assist in intermixing and/or dispersing adhesive released with the displacement of adhesive containers in the manner described for attachment device 20. Stem 458 may then be separated from attachment device 420 by breaking at point 460. After being disposed within cavity 432 as desired, the released adhesive may be used to bond to tendon 438, coupling it to attachment device 420. Collar 431 may be positioned to bear against a plate, concrete beam, or other member through which tendon 438 and attachment device 420 extend once bonding of tendon 438 has taken place.

Figure 9:
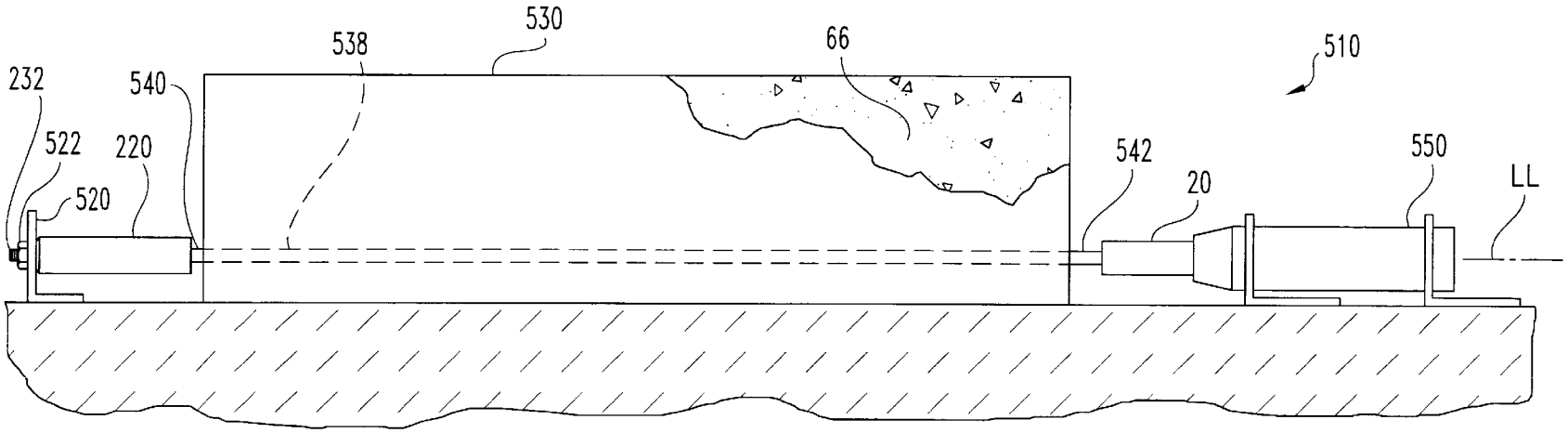
FIG. 9 is a partial diagrammatic view of a system for forming a prestressed concrete beam.

Referring to FIG. 9, a prestressed beam forming system 510 of yet another embodiment of the present invention is illustrated. System 510 includes a concrete beam form 530 configured to receive and set concrete in a predetermined beam shape. Tendon 538 extends through a lower portion 530*a* of form 530 and has opposing end portions 540, 542 extending from opposite sides of form 530 along system longitudinal axis LL. Using standard techniques, form 530 is configured to retain fluent, viscous materials, such as uncured concrete CC, without unacceptable loss through openings (not shown) through which tendon 538 passes. End portion 540 of tendon 538 is coupled to attachment device 220 of the type shown in FIG. 6. Threaded stem 232 of attachment device 220 extends through an aperture in anchoring plate 520. Plate 520 is fixed relative to form 530. Nut 522 engages threaded stem 232 to secure tendon 538 to plate 520.

End portion 542 of tendon 538 has attachment device 20 connected thereto by adhesive material as illustrated in FIGS. 1–4. Attachment device 20 is engaged by hydraulic stress jack 550 as schematically illustrated in FIG. 9. For system 510, at least end portions 540, 542 are formed from a fiber-reinforced polymeric resin. For this composition of tendon 538, the adhesive coupling to attachment devices 220, 20 provide a means to apply tension to tendon 538 with transverse stresses to tendon 538 being reduced to an acceptable minimum.

In one embodiment of a process for making a concrete beam with system 510, tendon 538 is placed in form 530 with end portions 540, 542 protruding from opposite sides along axis LL. Attachment devices 220, 20 are connected to end portions 540, 542, respectively, before or after placement of tendon 538 in form 530. In one example, tendon 538 may be unwound from a reel of fiber-reinforced polymeric resin composite material to a selected length as it is being placed in the form, and is then severed from the reel. For this example, at least one of the attachment devices 20, 220 is connected after placement in form 530. In another example, tendon 538 is provided in a length suitable for form 530 before placement therein. For this later example, attachment devices 20, 220 may be connected to tendon 538 before or after tendon 238 is placed through form 530. In still other examples, different procedures may be utilized.

Stem 232 of attachment device 220 is positioned to extend through the aperture in anchoring plate 520. Once adhesive material within attachment device 220 has cured, bonding with end portion 540 of tendon 538, nut 522 is threaded on stem 232 to bear against plate 520. Engagement portion 30 of attachment device 20 is secured to stress jack 550. Once adhesive material within attachment device 20 has bonded with end portion 542 of tendon 538, stress jack 550 is actuated to apply a desired amount of tension on tendon 538. Tendon 538 is placed in tension before, during, or after concrete CC is introduced into form 530. Tendon 538 remains under tension as the introduced concrete CC sets. With the setting of concrete CC, the tensioned tendon 538 and the concrete CC bond together. After bonding, tendon 538 is released from tension which tends to impose a compression component on the lower part of a concrete beam formed from concrete CC with form 530. So configured, the application of a load to a top portion of the resulting beam corresponding to top portion 530*b* of form 530, may be supported with less risk of tensile cracking.

In general, this technique may be applied to reduce the amount of concrete and/or reinforcement required for a concrete beam to support a given load. Attachment device 20 and/or attachment device 220 may be severed from tendon 538, and tendon 538 may otherwise be trimmed to a desired length after tension is released. In another embodiment, one or more of attachment devices may be left connected to tendon 538, or other types of attachment devices connected thereto. The concrete beam is released from form 530 for use as would occur to those skilled in the art. U. S. Pat. No. 5,613,334 to Petrina; U.S. Pat. No. 4,620,401 to L'Esperance et al.; U.S. Pat. No. 2,921,463 to Goldfein; and U.S. Pat. No. 3,167,882 to Abbott are referenced as additional sources of background information.

Figure 10:
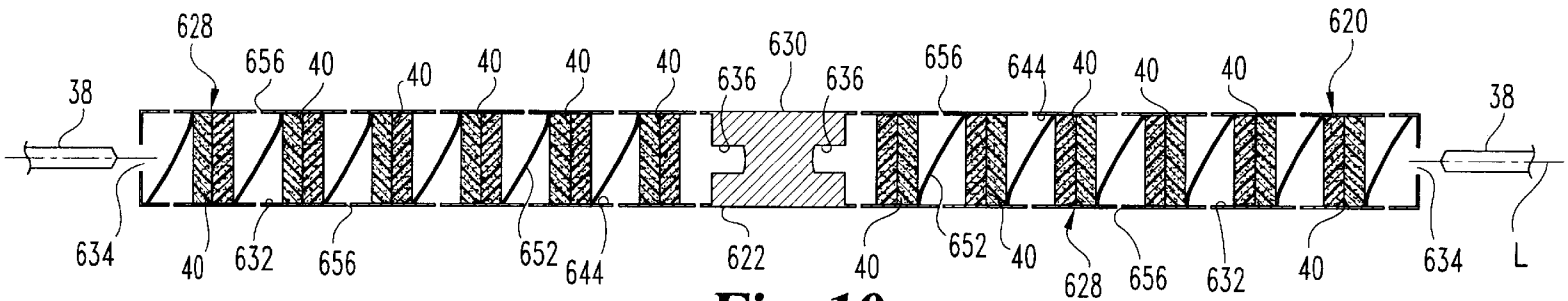
FIG. 10 is a partial sectional side view of an attachment device for coupling two tendons together.

Referring to FIG. 10, attachment device 620 is illustrated. Attachment device 620 is configured to couple two tendons 38 together. Attachment device 620 has body 622 with two attachment members 628 coupled together by coupling member 630. Each attachment member 628 defines a cavity 632 with an opening 634 configured to receive an end of one of tendons 38 therethrough. Each attachment member 628 has a number of adhesive containers 40 as described in connection with attachment device 20. Correspondingly, body 622 of attachment device 620 defines a number of venting apertures 656 through wall 644 of each attachment member 628. Only a few of apertures 656 are designated by reference numerals to preserve clarity. Each tendon 38 may be inserted in a corresponding one of cavities 632 to release, intermix, and disperse adhesive. Each tendon engages a respective one of alignment recesses 636 to generally center tendons 38 within the respective cavities 632. So positioned, tendons 38 each bond with the adhesive to be coupled together by attachment device 620. Coupling member 630 also includes partition/stop 631 separating cavities 632 of attachment members 628.

Attachment device 620 provides a convenient, prepackaged method to form a bonded coupling between two tendons 38. It should be appreciated that in other embodiments, couplers may be formed to receive more than two tendons by fixing additional attachment housing members 628 to coupling member 630, or providing such other arrangements as would occur to those skilled in the art. For example, attachment/coupling device may be configured with a T-shape to provide for joining of three elongated members or a cross shape to provide for joining four elongated members using techniques known to those skilled in the art. U.S. Pat. No. 4,666,326 to Hope illustrates coupling systems for more than two tendons that may be adapted for use according to the present invention.

In still other embodiments, attachment device 20 may be modified such that chambers 632 of each attachment housing member 628 are in communication with one another through alignment recesses 636. In still other embodiments, alignment recesses. 636 may be absent. Indeed, in one alternative, a single, uniformly shaped cavity is envisioned that receives tendons from opposite sides.

Referring generally to the embodiments of FIGS. 1–9, it should be understood that many alternative embodiments are envisioned. In other embodiments, tendons and attachments devices may not only be cylindrical with generally circular cross-sections, but may alternatively or additionally have different shapes and cross-sections as would occur to those skilled in the art. By way of nonlimiting example, the attachment device can have a generally square cross-section and the corresponding cavity can be generally rectilinear in shape, with the corresponding tendon still being of a cylindrical shape with a generally circular cross-section or otherwise shaped as would occur to those skilled in the art. Besides tendons, other elongated members may be connected to attachment devices of the present invention. Additionally or alternatively, while it is preferred to use flanges 52, 452, 652 in a spiral or helical configuration about a centerline axis of the given attachment device, in other embodiments such flanges may be differently shaped, may be discontinuous, or may be absent. Further, adhesive material may form a fixed bond with wall 44 of attachment member 28; however in certain embodiments, bonding between adhesive and attachment member 28 may not be necessary or desired, instead coupling with tendon 38 results by forming a plug on tendon 38 that cannot be readily withdrawn through the attachment device opening that receives the tendon. In still other embodiments, a different arrangement of apertures 56, 456, 656 may be utilized including more or fewer apertures.

For yet other embodiments, retention of an adhesive component in a given cavity 32, 432, 632 may be in the form of a single container or chamber that is retained within the respective cavity by as few as one seal, barrier, partition, or membrane. Indeed, such an adhesive may be of a single component type that cures when released. In addition to or as an alternative to a single container embodiment, multi-component adhesive may be used with less than all components being prepackaged within the attachment device. For such embodiments, the remaining component or components may be introduced with or carried by the tendon to be inserted therein, added through one or more openings into the attachment device cavity, or otherwise supplied as would occur to those skilled in the art.

In other embodiments, multiple containers may be used with one or more different orientations relative to cavity 32, 432, 632. For example, an adhesive material component may be formed as a pocket, chamber, blister, cell, capsule, or other structure that is attached to wall 44, 444, 644, but does not span across the respective cavity 32, 432, 632. In one alternative, a frangible membrane or other separating partition divides cavity 32, 432, 632 into two longitudinal chambers extending along axis L. Each chamber contains a corresponding adhesive constituent. These chambers are sealed at the corresponding cavity opening by a membrane or other barrier extending thereacross, transverse to axis L. In still other embodiments, one or more adhesive components may be retained within cavity 32, 432, 632 in pockets, cells, chambers, capsules, or blisters that freely move within cavity 32, 432, 632; but are retained therein by a partition, barrier, or membrane across opening 34, 434, 634, respectively.

Attachment devices 20, 120, 220, 320, 420, and 620 may be formed using techniques known to those skilled in the art. In one embodiment, the respective attachment device body is initially assembled from two or more pieces to facilitate placement of one or more adhesive containers in the corresponding cavity. In still another embodiment, the attachment device body is formed from a single, unitary piece defining the attachment member cavity with a shape suitable for the introduction of one or more adhesive containers therein. In still other embodiments, different techniques of manufacture may be used as would occur to those skilled in the art.

Yet other embodiments of the present invention include an attachment device including a cavity with an opening that has an adhesive positioned in the cavity and a removable or frangible partition positioned to retain the adhesive in the cavity. This device is configured to receive an elongated member through the opening that comes into contact with the adhesive material for bonding therewith.

In still another embodiment, a tendon attachment device is provided that includes a member defining a cavity and an end portion defining an opening into the cavity. The device includes an adhesive positioned in the cavity and a frangible barrier positioned to retain the adhesive in the cavity. An end of a tendon is inserted through the opening into the cavity. The barrier is broken to place the tendon in contact with the adhesive and the tendon is coupled to the attachment device with the adhesive. In one version, the tendon is made of a fiber-reinforced polymeric resin.

In a further embodiment of the present invention, a system includes an elongated member and an attachment device. The elongated member includes an end portion, at least a part of which has a fiber-reinforced polymeric resin composition. The attachment device includes a body defining a cavity in communication with an opening to receive the end portion therein and a plurality of containers spaced apart from one another along a longitudinal axis of the cavity to define a corresponding plurality of spaces therebetween. The containers each include at least one component of adhesive material. These containers are defined by a corresponding pair of a plurality of frangible barriers each extending across the cavity to be broken by insertion of the end portion into the cavity through the opening. The body of the attachment device defines a plurality of apertures each in fluid communication with a corresponding one of the spaces to vent gas from the spaces when displaced by the insertion of the first end portion into the cavity.

In still a further embodiment, an attachment device having an end portion is provided that defines a cavity. The end portion defines an opening in communication with the cavity. The attachment device includes an adhesive component positioned in the cavity and at least one frangible barrier to retain the adhesive in the cavity. A free end of a tendon is inserted through the opening and into the cavity. The barrier is broken to place the tendon in contact with the adhesive component. The attachment device is rotated about the first tendon to disperse the adhesive component within the cavity and the tendon is coupled to the attachment device with the adhesive component.

In yet a further embodiment of the present invention, an attachment device includes a member defining a cavity. This member includes a first end portion defining an opening intersecting the cavity to receive the end of a tendon. A first component of the adhesive material and a second component of the adhesive material are positioned in the cavity. A number of frangible partitions are connected to the member. These partitions are arranged to separate the first component from the second component and retain the first component and the second component in the cavity. The partitions are operable to break in response to insertion of the tendon into the cavity through the opening to put the first component and the second component in contact with each other.

In a different embodiment, an attachment device includes a member defining a cavity. The member includes an end portion defining an opening intersecting the cavity to receive an end of an elongate member, such as a tendon. A plurality of containers are spaced apart from one another along the cavity. These containers each include at least one component of an adhesive material and are each bounded by at least one of a corresponding number of frangible barriers connected to the member.

All publications, patents, and patent applications cited in this specification are herein incorporated by reference as if each individual publication, patent, or patent application were specifically and individually indicated to be incorporated by reference and set forth in its entirety herein. While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected.

What is claimed is:

1. A method, comprising:

providing an attachment device including a first end portion, the attachment device defining a cavity and the first end portion defining an opening intersecting the cavity, the attachment device including one or more components of an adhesive material positioned in the cavity and at least one frangible barrier to retain the one or more components in the cavity;

inserting a free end of a first tendon through the opening and into the cavity;

breaking the barrier to place the first tendon in contact with the one or more components of the adhesive material;

rotating the attachment device about the first tendon to disperse the one or more components of the adhesive material within the cavity; and coupling the first tendon to the attachment device with the adhesive material after said rotating.

2. The method of claim 1, wherein the adhesive material has two constituents separated during said providing, and said turning mixes the two constituents together.

3. The method of claim 1, wherein said turning includes connecting the attachment device to a rotary power tool and rotating the attachment device with the tool.

4. The method of claim 1, wherein the attachment device includes a second end portion opposite the first end portion, and further comprising connecting a stress jack to the second end portion of the attachment device to place the first tendon under tension after said coupling.

5. The method of claim 4, further comprising:

forming a prestressed concrete beam with the first tendon extending therethrough; and severing the attachment device from the first tendon after said forming.

6. The method of claim 1, wherein the attachment device is provided with a number of chambers each containing at least one component of the adhesive, the chambers each being defined by at least one of a corresponding number of frangible barriers, said inserting causing the barriers to rupture.

7. The method of claim 1, further comprising coupling the first tendon to a second tendon with the attachment device.

8. A method, comprising:

providing a tendon attachment device including a member defining a first cavity and a first end portion defining a first opening to the first cavity, the tendon attachment device including one or more adhesive components positioned in the first cavity and a frangible barrier positioned to retain the one or more adhesive components in the first cavity;

inserting a free end of a first tendon through the first opening and into the first cavity;

breaking the barrier to place the first tendon in contact with the one or more adhesive components;

rotating the attachment device about the first tendon after said breaking; and coupling the first tendon to the attachment device with the one or more adhesive components.

9. The method of claim 8, wherein the one or more adhesive components are provided in at least two separated parts before said inserting, and said rotating includes mixing the parts together.

10. The method of claim 8, further comprising coupling a stress jack to the attachment device after said coupling to place the first tendon under tension.

11. The method of claim 8, wherein the member defines a second cavity and includes a second end portion defining a second opening in communication with the second cavity, and the tendon attachment device includes a number of adhesive containers.

12. The method of claim 11, further comprising inserting a second tendon in the second cavity through the second opening to couple the first tendon and the second tendon together with the attachment device.

13. The method of claim 8, wherein the tendon attachment device is provided with a number of chambers each containing at least one component of the adhesive, the chambers each being at least partially defined by at least one of a corresponding number of frangible membranes.

14. The method of claim 13, wherein the chambers define a number of spaces therebetween along the first cavity, and the member defines a number of vents each in fluid communication with a corresponding one of the spaces.

15. The method of claim 13, wherein the membranes each span across the first cavity.

16. The method of claim 13, wherein the tendon attachment device includes at least one flange disposed within the first cavity.

17. The method of claim 8, wherein the free end of the first tendon is composed of a fiber-reinforced polymeric resin.

* * * * *